United States Patent [19]

Lenack et al.

[11] Patent Number: 4,956,110

[45] Date of Patent: Sep. 11, 1990

[54] AQUEOUS FLUID

[75] Inventors: Alain L. P. Lenack, Bonsecours; Fernand J. Kech, Mont-Saint-Aignan, both of France

[73] Assignee: Exxon Chemical Patents Inc., Linden, N.J.

[21] Appl. No.: 180,436

[22] Filed: Apr. 12, 1988

Related U.S. Application Data

[63] Continuation-in-part of Ser. No. 878,009, Jun. 24, 1986, abandoned.

[30] Foreign Application Priority Data

Jun. 27, 1985 [GB] United Kingdom ..... 8516301
Sep. 16, 1985 [GB] United Kingdom ..... 8522841

[51] Int. Cl.[5] ..... C10M 173/00; C10M 129/36

[52] U.S. Cl. ..... 252/49.5; 252/49.6; 252/73; 252/78.1; 72/42

[58] Field of Search ..... 252/49.5, 49.6, 73, 252/78.1; 72/42

[56] References Cited

U.S. PATENT DOCUMENTS

| | | | |
|---|---|---|---|
| 3,117,930 | 11/1964 | Kukin et al. | 252/33.3 |
| 3,371,047 | 2/1968 | Brunel | 252/389 |
| 3,374,171 | 3/1968 | Davis | 252/34.7 |
| 3,642,652 | 2/1972 | Birgy | 252/389 |
| 3,769,214 | 10/1973 | Davis | 252/34.7 |
| 3,813,337 | 5/1974 | Sheldahl | 252/33.4 |
| 3,933,660 | 1/1976 | Tadenuma et al. | 252/32.5 |
| 4,027,512 | 6/1977 | Treat | 72/42 |
| 4,105,783 | 7/1978 | Yu et al. | 424/283 |
| 4,129,509 | 12/1978 | Shringarpurey et al. | 252/49.5 |
| 4,177,155 | 12/1979 | Popplewell et al. | 252/49.3 |
| 4,197,316 | 4/1980 | Yu et al. | 424/317 |
| 4,226,734 | 10/1980 | Schuster | 252/49.3 |
| 4,239,634 | 12/1980 | Marin | 252/33 |
| 4,289,637 | 9/1981 | Dulat | 252/49.5 |
| 4,297,236 | 10/1981 | Diery et al. | 252/389 |
| 4,303,540 | 12/1981 | Schuster | 252/49.3 |
| 4,337,161 | 6/1982 | Stayner | 252/49.5 |
| 4,363,815 | 12/1982 | Yu et al. | 424/274 |
| 4,395,286 | 6/1983 | Sturwold | 106/14.13 |
| 4,434,066 | 2/1984 | Lewis | 252/77 |
| 4,440,654 | 4/1984 | Zimzik | 252/34.7 |
| 4,483,777 | 11/1984 | Shim | 252/49.5 |
| 4,533,481 | 8/1985 | Jahnke | 252/49.6 |

FOREIGN PATENT DOCUMENTS

| | | |
|---|---|---|
| 187218 | 4/1978 | Czechoslovakia . |
| 0206833 | 12/1986 | European Pat. Off. . |
| 1345593 | 9/1970 | United Kingdom . |
| 1476891 | 3/1975 | United Kingdom . |

*Primary Examiner*—William R. Dixon, Jr.
*Assistant Examiner*—Ellen M. McAvoy
*Attorney, Agent, or Firm*—Myron B. Kapustij; Vivienne T. White

[57] ABSTRACT

The use of a water-soluble hydroxyl di- or tri-carboxylic acid, generally in combination with an alkanolamine in an oil water fluid especially metal working or hydraulic fluids results in a fluid having excellent hard water compatibility, low foaming tendency in soft water and a good biostability; other additives such as emulsifiers, copper passivators and the like are generally present.

79 Claims, No Drawings

AQUEOUS FLUID

The present application is a continuation-in-part application of copending application Ser. No. 878,009, filed June 24, 1986, now abandoned.

The present invention relates to aqueous fluids; especially aqueous cutting fluids and hydraulic fluids, emulsifiable oils suitable for incorporation into water for production of such fluids, additives and additive concentrates for incorporation into such fluids and emulsifiable oils.

Emulsified oils are now used in a large number of machining operations due to an industry demand for higher production rates, lower costs, improved environmental conditions and better operator acceptance. Emulsions are generally used where cooling is more important than lubrication. In operations such as broaching, deep drilling, or where surface finish is particularly critical, neat oils may still be used, but the development of extreme pressure additives in emulsions has increased their applicability and use.

The emulsions are generally prepared from emulsifiable oils supplied to the final user for incorporation into the water. The emulsifiable oils frequently contain additives which can be supplied as an additive package, formulation or concentrate to the producer of the emulsifiable cutting oil. The invention relates to particular additives, concentrates, emulsifiable oils and water/oil fluids containing the additives.

Amongst the various types of fluids, there is a marked trend towards those having an optimized combination of lubricating, cooling and long-life properties. Such fluids are obtained by micro-emulsification of a base oil formulated with anti-corrosion and biostability agents. The microemulsion type of cutting fluid has good stability due to the very small size of their hydrocarbon droplets which do not tend to coalesce during storage. This feature is a key advantage over conventional fluids forming white emulsion whose hydrocarbon droplet size is much larger, where formulation with water-soluble biostability agents is difficult.

Aqueous metal working fluids have been known for many years and different additives have been developed to provide oils useful for different types of metal working and for use with different types of water.

For example, it is known that salts of long-chain alkyl-sulphonamidocarboxylic acids have an emulsifying and corrosion-inhibiting effect when used in metal processing. Compounds of this type, which are described in German Patent No. 900041, are generally obtained in admixture with the starting hydrocarbon because of their preparation method, and they are mainly applied in the form of oils. For reasons of the sensitivity of such emulsions to foreign salts, elevated temperature and germ infection, oil-free metal processing agents have been developed such as those described in United Kingdom Patent No. 1298672 and German Offenlegungsschrift No. 1771548. However, these water-soluble metal processing agents, although being free from the drawbacks of the emulsions, display an insufficient activity especially in hard water; precipitation of calcium salts provokes formation of sticky deposits on the machines and results in depletion of active substances in the solution.

For improving the corrosion-proofing effect, sodium nitrite has often been added to the fluids. However, because of the toxicity problems and the risk of formation of the carcinogenic nitrosamines from nitrite and the amines contained in many corrosion inhibitors, such additives are not widely used.

It is also known from, for example, U.S. Pat. Nos. 2,999,564, 3,764,593, 3,769,214 and 4,400,284, that mixtures of boric acid and alkanolamines, to which fatty acids having from 18 to 22 carbon atoms are optionally added; yield water-soluble metal working fluids; boric acid providing resistance to bacteria formation. However, apart from an insufficient corrosion-inhibiting effect, these fluids have the disadvantage of foaming during use. It has also been proposed in U.S. Pat. No. 3,371,047 that salts of the alkanolamines and hydroxy carboxylic acids, such as citric acid, tartaric acid maybe used optionally together with boron containing compounds in an oil free metal coating formulation using an excess of acid relative to the alkanolamine United Kingdom Patent No. 1345593 discloses the use of similar salts in oil free systems for metal coating.

U.S. Pat. No. 4,129,509 suggests that the use of metal tartrates and citrates is a convenient way of introducing metal ions into a cutting oil. In this patent the quantity of acid introduced is extremely small.

It has also been proposed that piperazine derivatives formed in a condensation reaction at elevated temperature from amino-alcohols, boric acid and carboxylic acids, be used as corrosion inhibitor, cooling, lubricating and cutting agent (German Patent No. 1620447). However, their corrosion inhibiting action is not superior to that of the hitherto known products.

Various emulsifiers have been proposed for the production of water in oil and oil in water emulsions. Typical emulsifiers are the sulphonates, such as the natural and synthetic petroleum sulphonates and the synthetic alkylaryl sulphonates, such as the $C_{12}$–$C_{24}$ alkyl benzene and toluene sulphonates and mixtures therefore as described in United Kingdom patent specification No. 1476891.

While many cutting oils containing the additives of the type described above and fluids obtained therefore have been satisfactory and have been accepted commercially, there is still need for additives which may be used in hard or soft water leading to good compatibility between oil and hard water, a low foaming tendency when soft water is used, good bio-stability and a sufficiently low pH. In addition from an environmental standpoint there is a need to reduce or eliminate the boron content of aqueous cutting fluids.

Hydraulic fluids are used in many mechanical operations and are generally oil in water emulsions. While foaming is less critical than in metal working it is important in many uses that these fluids have good bio-stability and, especially in applications such as hydraulic supports for rooves in mines that a stable emulsion can be formed with the water that is naturally available on site which can be very hard containing large amounts of calcium.

We have now found according to the present invention that oil/water fluids having a good combination of anti-bacterial properties compatibility of oil and hard water and a reduced foaming tendency when used in soft water and at times a reduced boron content may be obtained by the use as additive of a water-soluble hydroxy di- or tri-carboxylic acid particularly in combination with an alkanolamine which is preferably in excess.

The invention also provides additive concentrates for incorporation into emulsifiable oils containing a mixture of an alkanolamine and a water soluble hydroxy dior tri-carboxylic acid optionally together with other additives.

The invention further provides emulsifiable oils containing a mixture of an alkanolamine and a water soluble hydroxyl di- or tri-carboxylic acid optionally together with other additives.

In a further aspect the invention provides oil/water fluids containing the combination of an alkanolamine and a water-soluble hydroxy di- or tri-carboxylic acid optionally together with other additives.

Where the fluids of the present invention are aqueous metal working fluids they may be water in oil emulsions or oil in water emulsions, largely depending upon whether lubrication or cooling is the more important. We are, however, particularly concerned with the currently more popular high water content micro emulsion cutting fluids.

The additives may be supplied to a producer of emulsifiable oils or to the producer of the aqueous fluids. In either instance they may be supplied as a solution or an emulsion of the various additives for incorporation into oil or the bulk of the water. The solution may be in oil or water and if in oil it will generally contain some water.

The emulsifiable oil supplied to the final user generally contains an emulsifier to enable the production of oil in water or water in oil emulsions and any suitable emulsifier may be used, the choice depending upon the nature of the oil and the type of emulsion required. Alternatively the final user may introduce the emulsifier into the fluid separately. Salts of the synthetic alkyl benzene sulphonic acids, particularly the mixtures which form the subject of United Kingdom Patent No. 1476891 are our preferred emulsifier, other suitable emulsifiers are the sulphamido carboxylates such as those described in French Patent No. 2403396 and the sulphonates described in European Patent Application No. 0015491.

The preferred emulsifiers are salts of alkylaryl sulfonic acids and an organic or mineral base, wherein the molecular weights of the acids from which the salts are derived are distributed in accordance with the function $C=f(M)$, where C denotes concentration and M denotes molecular weight of individual acids, which function has two distinct molecular weight maximum M1 and M2, with $M1>M2$.

These sulfonic acid salts may be either inorganic or organic. The preferred inorganic salts are sodium salts. However, ammonium salts, or those of the other alkali metals, or of the alkaline earth metals are possible. The organic bases which may be employed are nitrogen bases, for example, a primary, secondary or tertiary amine, a polyamine, an alkanolamine etc. The preferred organic bases are monoethanolamine, diethanolamine, triethanolamine.

We prefer that the value of M1 should be at least 270. The value of M1 may be 270 to 360, but is preferably 270 to 400 and is more preferably from 360 to 400. In general, the value of M2 should be from 350 to 600 and is preferably from 450 to 550.

It is also preferred that the difference $M2-M1$ shall be at least 40, desirably in the range 40 to 350. Especially advantageous emulsifier compositions are obtained when the difference $M2-M1$ lies in the range 80 to 350, particularly 80 to 220.

The overall mean molecular weight of the alkylaryl sulfonic acids contained in the alkylaryl sulfonate compositions is chosen as a function of the nature of the base with which they are combined and of the particular use for which the emulsifier is intended. The most favorable overall mean molecular weight depends in particular on the more or less polar character of the organic phase it is desired to disperse in water. In most cases the overall mean is between 300 and 550, preferably 300 to 500, more preferably 375 to 500.

It is preferred that the alkyl groups of the alkylaryl sulfonates are branched-chain alkyl groups since improved emulsion stability is often found in such cases. Accordingly, it is preferred that at least a proportion of an emulsifier composition is made up of branched-chain alkyl type compounds. Preferably a major proportion, and most preferably all, the composition is of such compounds.

Highly preferred are alkylaryl sulfonates derived from benzene and orthoxylene, especially when the alkyl groups are branched-chain, for example, when propylene, butene or isobutylene oligomers are used for alkylation.

We prefer that the emulsifiable cutting oil for incorporation into bulk water contains from 3 to 35 wt %, preferably 3 to 25 wt %, more preferably 7 to 20 wt % of the emulsifier.

Where the fluids of the present invention are to be used for metal working they may be boron free although small amounts of boron may be required for the necessary anti-bacterial properties. Boron may be provided by incorporating boric acid or any other boron compound that forms boric acid upon being dissolved in water, such as metaboric acid or boric oxide. It is believed that the boric acid forms an addition product or salt with the amine which is a syrupy liquid and does not precipitate out of the cutting fluid. The emulsifiable oil may contain up to 30 wt % boric acid although we prefer that it contains from 2 to 6 wt % of boric acid to give no more than 1.0, preferably no more than 0.4 wt % boron in the final aqueous metal working fluid.

Examples of hydroxy di- or tri-carboxylic acids which may be used are tartaric and citric acids. It is important that the acid used be soluble in water. We prefer that the additive concentrate contain from 3.0 to 50.0 wt % of the acid and the emulsifiable oil contain from 1.0 to 10 wt % more preferably 1.0 to 7 wt % of the acid.

The alkanolamines used in the present invention, are those which contain from one to three aliphatic radicals, each containing from one to four carbon atoms, and have at least one hydroxy group attached to a carbon atom, and include primary, secondary and tertiary alkylol amines such as mono-di-or triethanolamine. These amines are generally water-soluble and have no offensive odor The preferred amine for use in preparing the cutting fluid of the invention is diethanolamine, which ordinarily contains minor amounts of mono-or triethanolamine, and has no odor We prefer that both the emulsifiable oil and the aqueous fluid contain an excess of alkanolamine relative to total acid content, i.e. the hydroxyl di- or tri-carboxylic acid together with any boric acid that may be present. We prefer to use a 10 to 20 % excess and a typical emulsifiable oil contains 10 to 35 wt % of alkanolamine.

A coupling agent suoh as a non-ionic wetting agent is generally used in aqueous metal working fluids embodying the invention. To improve the compatibility of the components, any desired non-ionic wetting agent may be used, such as a condensation product of ethylene oxide; a condensation product of a fatty acid or derivative, such as a derivative of a fatty acid, fatty alcohol, fatty amide or fatty amine, with ethylene oxide; and a reaction product obtained by the condensation of an oxyalkylaryl compound, such as a derivative of an alkylphenol or alkylnaphthol, with ethylene oxide. It is preferable that the non-ionic wetting agent employed be water-soluble. Typical non-ionic wetting agents include the polyethoxyesters of fatty acids, the monooleate of a polyethylene glycol, the monolaurate of a polyethylene glycol, the polyethoxyethers of fatty alcohols, the condensation product of an alkylphenol such as dodecyl phenol with 12 moles of ethylene oxide, and the sulfonated product of the condensation of an alkylphenol or an alkylnaphthol with ethylene oxide.

A particularly useful non-ionic wetting agent is an alkyl phenoxy polyethoxy ethanol such as octyl or nonyl phenoxy polyethoxy ethanol.

We also find, particularly when emulsifiers other than sulphonic acids and sulphonates are used that carboxylic acids such as neo acids and fatty acids may be included to enhance emulsion production. The amount required depends on the other components present but typically 2 to 10% based on the hydroxy di- or tri-carboxylic acid or 10% to 30% if boric acid is also present.

A typical emulsifiable oil according to the invention contains:

7 to 25 wt % emulsifier
0 to 15 wt % boric acid
1 to 10 wt % hydroxy di- or tri-carboxylic acid
Up to 35 wt % alkanolamine and an excess relative to the total acid content 0 to 60 wt % water with the balance oil.

Which is then included at from 1 to 10 wt %, preferably 1 to 5 wt %, more preferably 2 to 5 wt % in water to give the final aqueous fluid.

An aqueous metal working fluid embodying the invention may be used in all metal working operations but gives excellent results in applications in which the pressure per unit of area is relatively low, such as surface grinding operations especially where a number of pieces are being ground simultaneously. For heavy-duty applications, in which the pressure per unit of area is relatively high, an aqueousfluid embodying the invention preferably contains, in addition to the reaction product, antiwear additives such as phosphate esters, sulfurized hydrocarbons and copper passivator such as benzotriazole, tolyltriazole and its derivatives, thiadiazole and dimercapto thiadiazole.

Other ingredients which may be incorporated in the aqueous fluids include silicone anti-foaming agents and biocides.

The hydroxy di- or tri-carboxylic acid used in this invention, together with the alkanolamine, has been found to generally result in improved hard water compatibility, to give a low foaming tendency in fluids based on soft water and good biostability. However, use of the composition in soft water can result in some undesirable foaming during use and the present invention also includes the inclusion of calcium and/or magnesium salts to reduce foaming of soft water systems. The calcium and/or magnesium can be provided by the inclusion of halides, sulphates, sulphonates or carboxylates which may be present in the additive concentrate, the emulsifiable oil or added separately to the aqueous fluid. Conveniently, from 0.01 to 0.5 wt % of calcium or magnesium is incorporated in the fluid for use in water of hardness lower than 20° French degree TH (corresponding to 200 ppm of calcium carbonate). The improved hard water compatibility is especially useful in the production of hydraulic fluids such as those used in mining operations as for example in the support of rooves where the local water is extremely hard, for example above 500 ppm of calcium carbonate.

Although the presence of water in the emulsifiable oil is not essential the inclusion of water gives a control of its viscosity which is preferred to be below 500 centistokes at 20° C. for easier handling. We prefer that the formulation contain from 0 to 60 wt % water.

The emulsifiable oil generally contains 5 to 35, more preferably 5 to 14 wt % oil although larger amounts could be used which may be all the oil required in the final fluid or further oil may be added. Any type of oil may be used, mineral or synthetic and the mineral oils may be paraffinic or naphthenic although it may be necessary to alter the additives particularly any emulsifier according to the type of oil.

In the preparation of an emulsifiable oil embodying the invention, the ingredients are mixed at ordinary temperatures to produce a water-miscible fluid. We prefer to first mix the water and the alkanolamine then add the acid, any extreme pressure additives, then the emulsifier and the oil. The surfactant and any other wetting agent may also be added at room temperature, with stirring, to the aqueous solution prepared from the amine and boric acid when used. Preferably the amount of the non-ionic wetting agent is at least 5 percent by weight of the amount of the emulsifier.

When an amine salt of a fatty acid is incorporated in the fluid, the amount of the non-ionic wetting agent may be as much as 30 percent by weight of the amount of the emulsifier in order to hold the salt in solution and to prevent the precipitation of a calcium/magnesium soap if the concentrate is to be diluted with hard water.

The ingredients which form an aqueous fluid embodying the invention may be mixed in any desired order, but it is usually convenient to mix the major ingredients to form a liquid of relatively large bulk with which the minor ingredients may be readily mixed.

The additives may be supplied to the producer of the emulsifiable oil or the producer of the aqueous fluid in the form of a concentrate which preferably contains only the minimumamount of water required to form a stable liquid generally 1 to 10 wt %. Typically the concentrates contain from 3.0 to 50 wt % of the hydroxy di- or tri-carboxylic acid, from 0 to 30 wt % of boric acid, up to 25 wt % of alkanolamine and an excess relative to the total acid content, 3.0 to 50 wt % of emulsifier optionally other additives the balance being water or oil and water. The concentrate is then incorporated either into oil to give the emulsifiable oil or direct in water to give the final fluid. Cutting fluids generally contain 1 to 10 wt % of such a concentrate, preferably 1–5 wt %.

Another aspect of the present invention relates to microemulsion fluids, especially microemulsion cutting fluids and hydraulic fluids, microemulsifiable oils suitable for incorporation into water for production of such fluids, additives and additive concentrates for incorporation into such fluids.

Microemulsions distinguish over conventional emulsions or macroemulsions by the particle size of the dispersed phase, e.g., oil, in the continuous phase, e.g., water. Generally, in microemulsions the average particle size, i.e., diameter of the particles of the dispersed phase, is no greater than about 1,000 Angstroms.

The microemulsions of this aspect of the present invention offer several advantages over the conventional macroemulsions. The first advantage is that they are thermodynamically more stable than conventional emulsions, i.e., macroemulsions. That is to say, these microemulsions are more stable than conventional emulsions in that the dispersed phase, e.g., oil, does not separate from the continuous phase, e.g., water, as easily or quickly as in conventional emulsions. The second advantage is that the microemulsions possess better optical properties than conventional emulsions. While macroemulsions are generally relatively milky in appearance, the microemulsions are relatively optically clear and substantially transparent. Thus, when the microemulsions of this aspect of the present invention are used as cutting fluids they do not obscure the workpiece, thereby aiding the operator in the cutting operation. This optical clarity is believed to be due to the very small particle size of the dispersed phase.

The particles of the dispersed phase, e.g., the oil phase of an oil in water microemulsion, have a diameter of no greater than about 1,000 Angstroms, preferably between about 50 and about 1,000 Angstroms. This small particle size is obtained by controlling the ratio of the emulsifier to oil in these microemulsions. In producing microemulsions the ratio of emulsifier to oil is any ratio which is effective to produce a microemulsion. Generally, a weight ratio of oil to emulsifier no greater than about 2.5:1 is effective in producing microemulsions. Thus, for example, if the ratio of oil to emulsifier is higher than about 2.5:1, e.g., 4:1, the resultant emulsion will be a macroemulsion and not a microemulsion. Preferably the weight ratio of oil to emulsifier is no greater than about 1.5:1, more preferably no greater than about 1:1. Generally, the microemulsions have an oil to emulsifier ratio, by weight, of from about 2.5:1 to about 0.1:1, preferably from about 1.5:1 to about 0.4:1, and more preferably from about 1:1 to about 0.6:1.

The microemulsions of this aspect of the invention are preferably oil in water microemulsions. The microemulsion compositions of this aspect of the present invention contain the same types and amounts of constituent components as described hereinbefore with the proviso that they contain amounts of oil and emulsifier which are effective to provide microemulsion, i.e., amounts of oil and emulsifier which are effective to provide a ratio of oil to emulsifier from about 2.5:1 to about 0.1:1, preferably from about 1.5:1 to about 0.4:1, and more preferably from about 1:1 to about 0.6:1.

EXAMPLES

EXAMPLE 1

The emulsifiable oils of Table 1 were prepared and incorporated into water at 3 wt. % to give cutting fluids having the performance set out in Table 1.

TABLE 2

| Emulsifiable Cutting Oil | 0 | 1 | 2 | 3 |
|---|---|---|---|---|
| Mixture of sodium sulphonates marketed by Exxon Chemical Company as SYNACTO 2000 | 12.6 | 12.2 | 13.8 | 13.9 |
| Stanco 90 (or Mineral Oil) | 9.0 | 7.4 | 6.3 | 5.5 |
| Butylcarbitol | 3.2 | 4.4 | 5.2 | 4.9 |
| Ethoxylated tolyl triazole | 0.2 | 0.2 | 0.2 | 0.2 |
| Diethanolamine | 30.0 | 34.5 | 28.0 | 35.8 |
| Monoethanolamine | | | 2.8 | |
| Water | 35.0 | 33.7 | 34.1 | 28.8 |
| Boric Acid | 3.8 | | | 5.1 |
| Tartaric Acid | 6.2 | 7.6 | 6.9 | |
| Citric Acid | | | | 5.8 |
| Triazine Bactericide | | | 2.7 | |
| Performance at 3 wt % in water | | | | |

TABLE 2-continued

| Emulsifiable Cutting Oil | 0 | 1 | 2 | 3 |
|---|---|---|---|---|
| Anti-corrosion (CNOMO** D 635200) | 0–0 | 0/1–1 | 0/1–1 | 0–0 |
| Foaming (CNOMO D 655212) | | | | |
| in soft water (100 ppm calcium carbonate) | pass | pass | pass | fail |
| in hard water (400 ppm calcium carbonate) | pass | pass | pass | pass |
| Hard water compatibility (visual appraisal of scum deposit) | no scum | no scum | no scum | no scum |
| pH of emulsion | 9.1 | 9.3 | 9.5 | 9.3 |
| Biostability, weeks* | 7 | 6 | 18 | 13 |

**Committee De Normalisation De La Machine Outiels as recognized by the French Automobile industry.

The test is run on a liter emulsion sample alternatively submitted to 8 hours with and 16 hours without air blowing. Comparisons are made regularly with cutting fluids highly contaminated by bacteria (108 bacteria/ml), urine, bread, beer and also with inorganic salts, mineral oils containing sulfurized extreme pressure additives and chips of cast-iron and steel. The test is stopped when the bacterial development reaches 108/ml. Then the main characteristics of the aged emulsion are checked against those of the fresh fluid.

EXAMPLE 2

For comparison similar emulsifiable cutting oils were made using other carboxylic acids with the following results.

| Emulsifiable Cutting Oils | 4 | 5 | 6 | 7 | 8 |
|---|---|---|---|---|---|
| Mixture of sodium sulphonates marketed by Exxon Chemical Company as SYNACTO 2000 | 18.3 | 18.3 | 18.3 | 18.3 | 18.3 |
| Stanco 90 | 14.3 | 14.3 | 14.3 | 14.3 | 14.3 |
| Butylcarbitol | 5.3 | 5.2 | 5.0 | 4.8 | 4.8 |
| Ethoxylated tolyl triazole | 0.2 | 0.2 | 0.2 | 0.2 | 0.2 |
| Diethanolamine | 13.0 | 13.0 | 13.0 | 13.0 | 13.0 |
| Monoethanolamine | 4.1 | 4.6 | 4.4 | 3.9 | 4.6 |
| Water | 38.0 | 38.0 | 38.0 | 38.0 | 38.0 |
| Boric Acid | 4.6 | 4.9 | 4.8 | 4.5 | 5.1 |
| Formic Acid | 1.5 | — | — | — | — |
| Acetic Acid | — | 1.5 | — | — | — |
| Oxalic Acid | — | — | 2.0 | — | — |
| Succinic Acid | — | — | — | 3.0 | — |
| Ethylenediamine-tetra acetic acid | — | — | — | — | 2.5 |
| Performance at 3 wt % in water | | | | | |
| Anti-corrosion (CNOMO D 635200) | 2–2 | 2–2 | 1–2 | 1–2 | 2–3 |
| Foaming (CNOMO D 655212) | | | | | |
| in soft water (100 ppm calcium carbonate) | fail | fail | na | na | fail |
| in hard water (400 ppm) calcium carbonate | pass | pass | na | na | fail |
| Hard water compatibility (visual rating of scum deposit) | not acceptable | | | | no scum |
| pH of emulsion | 9.3 | 9.3 | 9.4 | 9.4 | 9 |

EXAMPLE 3

Further emulsifiable cutting oils were prepared using different emulsifiers and containing various amounts of an additive package (Package A) containing

| Component | mass % |
|---|---|
| Ortho Boric acid | 8.51 |
| Diethanolamine | 67.16 |

-continued

| | |
|---|---|
| Ethoxylated tolytriazole | 0.45 |
| Tartaric acid | 13.88 |
| Water | 10.00 |

The emulsifiable oils and performance in the cutting oil were as follows

| Emulsifiable Oil | 9 | 10 | 11 | 12 | 13 |
|---|---|---|---|---|---|
| Package A | 38.5 | 37.6 | 41 | 28 | 28.6 |
| Emulsogen H* | 14.4 | 18.8 | 13.6 | — | — |
| Emulsogen B2M* | — | — | — | 18.7 | — |
| Bornmittel* | — | — | — | — | 19.0 |
| Ethoxylated Alcohol | 3.8 | 3.7 | 4.5 | 4.7 | 4.8 |
| Tall oil fatty acid | 4.8 | 2.3 | 4.5 | 4.7 | 4.8 |
| Oil | 9.5 | 9.4 | 9.0 | 14.0 | 14.3 |
| Water | 29.0 | 28.2 | 27.4 | 29.9 | 28.5 |
| Emulsion | | | | | |
| 3% in water containing 350 ppm calcium carbonate | Clear | Clear | Clear | Clear | Clear |
| pH at 10% in distilled water | 9.15 | 9.2 | 9.25 | 9.05 | 9.2 |
| DIN 51360-2 corrosion test - rating 0 at volume % | 2.5 | 2.5 | 2.5 | — | 2.5 |
| DIN 51360-1 corrosion test - rating 0 at volume % | 3 | 3 | 2 | — | 2.5 |
| Foaming (IP 312) | | | | | |
| in water containing 500 ppm calcium carbonate | 50 | 60 | 70 | — | 80 |
| in water containing 200 ppm calcium carbonate | 90 | 110 | 100 | — | 100 |

Sowing less good foaming results than with the emulsifiers 35 used in Example 1.

EXAMPLE 4

Additive Package B was prepared as follows:

| PACKAGE B | |
|---|---|
| Component | mass % |
| Citric acid | 8.53 |
| Diethanolamine | 74.84 |
| Polycarboxylic acid | 2.37 |
| Ethoxylalated tolyltriazole | 0.47 |
| Tartaric acid | 3.78 |
| Water | 10.01 |
| and tested with the emulsifiers used in Example 3 in the following formulation to give the following results | |
| Emulsifiable oil | 14 |
| Package B | 38.1 |
| Emulsogen H | 14.3 |
| Ethoxylated alcohol | 4.8 |
| Tall oil fatty acid | 4.8 |
| Oil (Stanco 90) | 9.6 |
| Water | 28.4 |
| Emulsion Properties | |
| 3% in water containing 350 ppm calcium carbonate | clear |
| Corrosion DIN 51360-1 Rating 0 at | 2.5 Vol % |
| Corrosion DIN 51360-2 Rating 0 at | 2.0 vol % |
| Foaming 5% in water containing 200 ppm calcium carbonate | 150 |

EXAMPLE 5

An emulsifiable oil for use in a hydraulic fluid containing very hard water (750 ppm of calcium carbonate) was prepared as follows.

| | |
|---|---|
| 100 N oil | 9.10 |

-continued

| | |
|---|---|
| Citric acid | 6.29 |
| Diethanolamine | 30.41 |
| Synacto 2000 | 14.65 |
| Butyl carbitol | 3.99 |
| Water | 35.56 |

When incorporated at 5% in the test water NCB 19 the pH was 9.3 and the hard water compatibility test NCB 463/1981 Appendix A was passed and the corrosion according to test NCB 463/1981 (App. B) in 2 wt. % in test water containing 2.9 mg/l NaCl solution gave no rusting.

The NCB 463/1981 Tests are standard tests as used by the United Kingdom National Coal Board.

The oil was also tested at 5 vol % in soft water containing $CaSO_4$ solution (equivalent to 50 ppm $CaCO_3$) for its foaming tendency and found to give a foam volume after 15 min of 4 ml.

EXAMPLE 6

The Synacto 2000 used in Example 5 was replaced by other emulsifiers such.#s the product Synacto 416 marketed by Esso Chemical to give the following emulsifiable oil.

| Component (mass %) | |
|---|---|
| Synacto 416 | 19.0 |
| Di-ethanol amine | 38.3 |
| Oil (Shell MVIN 40) | 8.3 |
| Water | 24.4 |
| Citric acid | 10.0 |

The oil was tested at 2 and 5 wt % in Minteck A water (2000 ppm $CaCO_3$+2000 ppm NaCl) to give the following results

| | at 70° C. | at 45° C. |
|---|---|---|
| H20 separation | none | none |
| Flocculation | none | none |
| Precipitation of solids | none | none |
| Oil separation, curds or cream | none | none |

The oil was tested at 2 and 5 wt % in Minteck B water (2000 ppm $CaCO_3$+4000 ppm NaCl) to give the following results

| | at 70° C. | at 45° C. |
|---|---|---|
| H20 separation | none | none |
| Flocculation | none | none |
| Precipitation of solids | none | none |
| Oil separation, curds or cream | none | none |

In addition the emulsified oil had the following properties:

| | |
|---|---|
| pH | |
| at 5 mass % in deionized water | 9.3 |
| Paper corrosion test | |
| (type DIN 513600-2) | |
| at 3% | |
| in Minteck A water | 3 |
| in Minteck B water | 4 |
| at 5% | |
| in Minteck A water | 2 |
| in Minteck B water | 2 |

-continued

| Emulsion oil stability | |
|---|---|
| 10 days at 45° C. | no separation |
| 10 days at 70° C. | tendency to separate |
| 10 days at −20° C. | no separation |

EXAMPLE 7

A boron-free additive formulation Package C was prepared as follows:

| | mass % |
|---|---|
| Ethoxylated tolyl triazole | 0.2 |
| Polycarboxylic acid | 1.0 |
| Dodecyl succinic anhydride | 1.2 |
| Citric acid | 3.6 |
| Tartaric acid | 1.6 |
| Diethanolamine | 31.9 |
| Water | 21.6 |
| Synacto 2000 | 24.0 |
| Stanco 90 | 14.9 |

The formulation was incorporated at various volumes in DIN water containing 360 ppm calcium carbonate and tested as follows:

| | |
|---|---|
| pH at 2% volume | 9.3 |
| pH at 2.5% volume | 9.4 |
| pH at 3.0% volume | 9.4 |
| Paper test DIN 51.360-2 at 2% vol | 1 |
| at 2.5% vol | 0 |
| at 3.0% vol | 0 |

The formation was also tested for foaming in various waters using the CNOMO D 655212 test.

| | |
|---|---|
| at 2.5% vol in 200 ppm calcium carbonate water | 300-200-10-0-250 |
| at 3.0% vol in 200 ppm calcium carbonate water | 300-300-20-0-250 |
| at 3.0% vol in 100 ppm calcium carbonate water | 5-1000-100-0-250 |
| pH after foaming test | 9.2 |

In the Gumming test CNOMO D65-1663 procedure B at 3% vol the result was 35 mN/meter.

Gumming test VK IS* 3% vol - in water viscous 100% re-solubility

The corrosion CNOMO D63-5200 in 400 ppm carbon carbonate water was

| | |
|---|---|
| at 2.0% vol | 1/2 |
| at 2.5% vol | 1/0 |
| at 3.0% vol | 0/0 |
| Corrosion DIN 51360-2 at 360 ppm calcium carbonate water was | |
| at 1 vol % | 0/4.3 |
| at 2 vol % | 0/2.2 |
| at 2.5 vol % | 0/1.2 |
| at 3 vol % | 0/1.1 |

The microemulsion was tested for biostability at 3 wt. % in water together with other commercially available bactericides using the test described in Example 1 to give the following results.

| Emulsified oil | 17 | 18 | 19 | 20 | 21 | 22 | 23 |
|---|---|---|---|---|---|---|---|
| Package C | 100% | 99.5 | 99 | 98.5 | 99.5 | 99.75 | 99 |
| di (methyloxo pyryl) methane | 0.5 | 1.0 | 1.5 | | | 0.5 | |
| tri(ethyl)1,3,5 hexahydrotriazine | | | | | 0.5 | 0.25 | 0.5 |
| Pollution at 108 bact/ml | | | | | | | |
| After weeks | 8 | 9 | 13 | 13 | 9 | 9 | 13 |
| Initial pH | 9.5 | 9.5 | 9.5 | 9.5 | 9.5 | 9.5 | 9.5 |
| Final pH | 8.3 | 8.4 | 8.2 | 8.2 | 8.4 | 8.3 | 8.4 |

What is claimed is:

1. An oil and water microemulsion additive concentrate comprising water, oil, emulsifier, and water-soluble hydroxy di- or tri-carboxylic acid, with the proviso that the ratio of oil to emulsifier is no greater than about 2.5:1 by weight.

2. The concentrate according to claim 1 wherein the ratio of oil to emulsifier is from about 2.5:1 to about 0.1:1.

3. The concentrate according to claim 2 wherein the ratio of oil to emulsifier is from about 1.5:1 to about 0.4:1.

4. The concentrate according to claim 3 wherein the ratio of oil to emulsifier is from about 1:1 to about 0.6:1.

5. The concentrate according to claim 1 wherein said hydroxy di- or tri-carboxylic acid is selected from the group consisting of citric acid, tartaric acid, and mixtures thereof.

6. The concentrate according to claim 5 wherein said hydroxy di- or tri-carboxylic acid is citric acid.

7. The concentrate according to claim 5 wherein said hydroxy di- or tri-carboxylic acid is tartaric acid.

8. The concentrate according to claim 5 which contains from 3.0 to 50.0 wt % of said hydroxy di- or tri-carboxylic acid.

9. The concentrate according to claim 1 which contains from 3.0 to 50.0 wt % of said hydroxy di- or tri-carboxylic acid.

10. The concentrate according to claim 1 which further contains boric acid.

11. The concentrate according to claim 10 which contains from 2 to 30 wt % boric acid.

12. The concentrate according to claim 1 which further contains a calcium or magnesium salt.

13. The concentrate according to claim 1 which contains up to 25 wt % of alkanolamine in an amount sufficient to provide a stoichiometric excess relative to the total acid content.

14. The concentrate according to claim 9 which contains up to 25 wt. % of alkanolamine in an amount sufficient to provide a stoichiometric excess relative to the total acid content.

15. The concentrate according to claim 11 which contains up to 25 wt % of alkanolamine in an amount sufficient to provide a stoichiometric excess relative to the total acid content.

16. The concentrate according to claim 2 which contains from 3 to 50 wt % of emulsifier.

17. The concentrate according to claim 16 which contains up to 35 wt % oil.

18. An oil and water microemulsion additive concentrate comprising:

(i) from 3.0 to 50 wt % of water soluble hydroxy di- or tri-carboxylic acid;

(ii) from 0 to 30 wt % boric acid;

(iii) up to 25 wt % of alkanolamine in an amount sufficient to provide a stoichiometric excess relative to the total acid content;
(iv) 3.0 to 50 wt % of emulsifier;
(v) oil; and
(vi) water;
with the proviso that the ratio of oil to emulsifier is no greater than about 2.5:1 by weight.

19. The concentrate according to claim 18 wherein the ratio of oil to emulsifier is from about 2.5:1 to about 0.1:1.

20. The concentrate according to claim 19 which contains up to 35 wt % of oil.

21. The concentrate according to claim 19 wherein the ratio of oil to emulsifier is from about 1.5:1 to about 0.4:1.

22. The concentrate according to claim 21 wherein the ratio of oil to emulsifier is from about 1:1 to about 0.6:1.

23. The concentrate according to claim 18 which contains from 2 to 30 wt % boric acid.

24. The concentrate according to claim 18 wherein said acid (i) is selected from the group consisting of citric acid, tartaric acid, and mixtures thereof.

25. The concentrate according to claim 24 wherein said acid (i) is citric acid.

26. The concentrate according to claim 24 wherein said acid (i) is tartaric acid.

27. A microemulsifiable oil composition containing:
(i) 7 to 25 wt % emulsifier;
(ii) 0 to 15 wt % boric acid;
(iii) 1 to 10 wt % water soluble hydroxy di- or tri-carboxylic acid;
(iv) up to 35 wt % of alkanolamine in an amount sufficient to provide a stoichiometric excess relative to the total acid content; and
(v) oil;
with the proviso that the ratio of oil to emulsifier is no greater than about 2.5:1 by weight.

28. The composition according to claim 27 wherein the ratio of oil to emulsifier is from about 2.5:1 to about 0.1:1.

29. The composition according to claim 28 wherein the ratio of oil to emulsifier is from about 1.5:1 to about 0.4:1.

30. The composition according to claim 29 wherein the ratio of oil to emulsifier is from about 1:1 to about 0.6:1.

31. The composition according to claim 27 wherein said acid (iii) is selected from the group consisting of citric acid, tartaric acid, and mixtures thereof.

32. The composition according to claim 31 wherein said acid (iii) is citric acid.

33. The composition according to claim 31 wherein said acid (iii) is tartaric acid.

34. A metal working microemulsion comprising water and from 1 to about 10 weight % of the microemulsifiable oil composition according to claim 27.

35. A hydraulic fluid microemulsion comprising water and from 0.5 to 10 weight % of the microemulsifiable oil composition according to claim 27.

36. An oil and water microemulsion comprising water, oil, emulsifier, alkanolamine, and water-soluble hydroxy di- or tri-carboxylic acid, with the proviso that the ratio of oil to emulsifier is no greater than about 2.5:1 by weight.

37. The microemulsion according to claim 36 wherein the ratio of oil to emulsifier is from about 2.5:1 to about 0.1:1.

38. The microemulsion according to claim 37 wherein the ratio of oil to emulsifier is from about 1.5:1 to about 0.4:1.

39. The microemulsion according to claim 38 wherein the ratio of oil to emulsifier is from about 1:1 to about 0.6:1.

40. The microemulsion according to claim 37 containing from 0.07 to 2.5 wt % of an emulsifier.

41. The microemulsion according to claim 36 containing from 0.01 to 1.0 wt % of hydroxy di- or tri-carboxylic acid.

42. The microemulsion according to claim 36 wherein said hydroxy di- or tri-carboxylic acid is selected from citric acid, tartaric acid, and mixtures thereof.

43. The microemulsion according to claim 42 wherein said hydroxy di- or tri-carboxylic acid is citric acid.

44. The microemulsion according to claim 42 wherein said hydroxy di- or tri-carboxylic acid is tartaric acid.

45. The microemulsion according to claim 36 containing up to 3.5 wt % of alkanolamine in an amount sufficient to provide an excess relative to the total acid content.

46. The microemulsion according to claim 36 which further contains boric acid.

47. The microemulsion according to claim 46 containing up to 1.5 wt % boric acid.

48. The microemulsion according to claim 47 containing up to 3.5 wt % of alkanolamine in an amount sufficient to provide an excess relative to the total acid content.

49. An oil in water microemulsion comprising:
(i) from 0.07 to 2.5 wt % of emulsifier;
(ii) from 0 to 1.5 wt % boric acid;
(iii) 0.01 to 1.0 wt % of a hydroxy di- or tri-carboxylic acid;
(iv) up to 35 wt % of alkanolamine in an amount sufficient to provide an excess relative to the total acid content;
(v) oil in an amount effective to provide a ratio of oil to emulsifier not greater than about 2.5:1 by weight; and
(vi) water.

50. The microemulsion according to claim 49 wherein the amount of oil is an amount effective to provide a ratio of oil to emulsifier of from about 2.5:1 to about 0.1:1.

51. The microemulsion according to claim 50 wherein the amount of oil is an amount effective to provide a ratio of oil to emulsifier of from about 1.5:1 to about 0.4:1.

52. The microemulsion according to claim 50 wherein the amount of oil is an amount effective to provide a ratio of oil to emulsifier of from about 1:1 to about 0.6:1.

53. The microemulsion according to claim 49 wherein said acid (iii) is selected from the group consisting of citric acid, tartaric acid, and mixtures thereof.

54. The microemulsion according to claim 53 wherein said tartaric acid (iii) is selected from tartaric acid.

55. The microemulsion according to claim 53 wherein said acid (iii) is citric acid.

56. An oil and water microemulsion comprising:
(i) from 0.07 to 2.5 wt% of emulsifier;
(ii) from 0 to 1.5 wt % boric acid;
(iii) 0.01 to 1.0 wt % of hydroxy di- or tri-carboxylic acid;
(iv) up to 3.5 wt % of alkanolamine in an amount sufficient to provide an excess relative to the total acid content;
(v) oil; and
(vi) water;
with the proviso that the ratio of oil to emulsifier is not greater than about 2.5:1 % by weight.

57. The microemulsion according to claim 56 wherein said acid (iii) is selected from citric acid, tartaric acid, and mixtures thereof.

58. The microemulsion according to claim 57 wherein said (iii) is tartaric acid.

59. The microemulsion according to claim 57 wherein said (iii) is citric acid.

60. A microemulsion additive concentrate comprising oil, emulsifier, alkanolamine, water, and water-soluble hydroxy di- or tri-carboxylic acid.

61. The microemulsion additive concentrate according to claim 60 further contains boric acid.

62. A microemulsion additive concentrate comprising oil, emulsifier, alkanolamine, water and water-soluble hydroxy di or tri-carboxylic acid, with the proviso that the ratio of oil to emulsifier is not greater than about 2.5:1 by weight.

63. The microemulsion additive concentrate according to claim 62 wherein said hydroxy di- or tri-carboxylic acid is citric acid.

64. The microemulsion additive concentrate according to claim 62 wherein said hydroxy di- or tri-carboxylic acid is tartaric acid.

65. The microemulsion additive concentrate according to claim 60 which contains from 3 to 50 wt % emulsifier.

66. The microemulsion additive concentrate according to claim 61 which contains from 2 to 30 wt % boric acid.

67. The microemulsion additive concentrate according to claim 60 which contains from 3.0 to 50 wt % of the hydroxy di- or tri-carboxylic acid.

68. A microemulsion additive concentrate containing:
(i) from 3.0 to 50 wt % of water-soluble hydroxy di- or tri-carboxylic acid;
(ii) from 0 to 30 wt % boric acid;
(iii) up to 25 wt % of alkanolamine in an amount sufficient to provide a stoichiometric excess relative to the total acid content;
(iv) 3.0 to 50 wt % of emulsifier;
(v) oil; and
(vi) water.

69. The microemulsion additive concentrate according to claim 68 wherein said acid (i) is selected from the group consisting of citric acid, tartaric acid, and mixtures thereof.

70. A microemulsion additive concentrate containing:
(i) from 3.0 to 50 wt % of water-soluble hydroxy di- or tri-carboxylic acid;
(ii) from 0 to 30 wt % boric acid;
(iii) up to 25 wt % of alkanolamine in an amount sufficient to provide a stoichiometric excess relative to the total acid content;
(iv) 3.0 to 50 wt % of emulsifier;
(v) oil; and
(vi) water;
with the proviso that the ratio of oil to emulsifier is not greater than about 2.5:1 by weight.

71. The microemulsion additive concentrate according to claim 70 wherein said acid (i) is citric acid.

72. A microemulsifiable oil containing:
(i) 7 to 25 wt % emulsifier;
(ii) 0 to 15 wt % boric acid;
(iii) 1 to 10 wt % hydroxy di- or tri-carboxylic acid;
(iv) up to 35 wt % of alkanolamine in an amount sufficient to provide an excess relative to the total acid content; the balance being
(v) oil.

73. The microemulsifiable oil according to claim 72 wherein said acid (iii) is selected from the group consisting of citric acid, tartaric acid, and mixtures thereof.

74. A microemulsifiable oil containing:
(i) 7 to 25 wt % emulsifier;
(ii) 0 to 15 wt % boric acid;
(iii) 1 to 10 wt % hydroxy di or tri-carboxylic acid;
(iv) up to 35 wt % of alkanolamine in an amount sufficient to provide an excess relative to the total acid content; the balance being (v) oil, with the proviso that the ratio of oil to emulsifier is not greater than about 2.5:1 by weight.

75. The microemulsifiable oil according to claim 73 wherein said acid (iii) is citric acid.

76. A microemulsifiable metal working fluid comprising water and from 1 to 10 wt % of the microemulsifiable oil according to claim 72.

77. A microemulsion hydraulic fluid comprising water and from 0.5 to 10 wt % of the microemulsifiable oil according to claim 72.

78. A metal working fluid microemulsion comprising water, oil emulsifier, and water-soluble hydroxy di- or tricarboxylic acid, wherein the ratio of oil to emulsifier is not greater than about 2.5:1 by weight.

79. An hydraulic fluid microemulsion comprising water, oil, emulsifier, and water-soluble hydroxy di- or tricarboxylic acid, wherein the ratio of oil to emulsifier is not greater than about 2.5:1 by weight.

* * * * *